US010367291B2

(12) United States Patent
Asai et al.

(10) Patent No.: US 10,367,291 B2
(45) Date of Patent: Jul. 30, 2019

(54) MAGNETIC CONNECTOR ARRANGED IN A BENDABLE HOUSING IN AN ELECTRICALLY CONDUCTIVE CONNECTOR ASSEMBLY

(71) Applicant: SMK Corporation, Tokyo (JP)

(72) Inventors: Kiyoshi Asai, Kanagawa (JP); Tomohito Okamura, Ibaraki (JP); Toshihiko Kato, Kanagawa (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/900,752

(22) Filed: Feb. 20, 2018

(65) Prior Publication Data

US 2019/0089087 A1 Mar. 21, 2019

(30) Foreign Application Priority Data

Sep. 21, 2017 (JP) ..... 2017-181027

(51) Int. Cl.

| | |
|---|---|
| ***H01R 11/30*** | (2006.01) |
| ***H01R 13/50*** | (2006.01) |
| ***H01R 13/62*** | (2006.01) |
| ***H01R 13/24*** | (2006.01) |

(52) U.S. Cl.

CPC ..... *H01R 13/501* (2013.01); *H01R 13/2471* (2013.01); *H01R 13/6205* (2013.01)

(58) Field of Classification Search

CPC ..... H01R 11/30; H01R 13/6205
USPC ..... 439/39, 91
See application file for complete search history.

(56) References Cited

U.S. PATENT DOCUMENTS

| | | | | |
|---|---|---|---|---|
| 5,941,729 A * | 8/1999 | Sri-Jayantha | ..... | H01R 13/6205 439/289 |
| 7,252,512 B2 * | 8/2007 | Tai | ..... | H01R 13/6205 439/39 |
| 9,300,081 B2 * | 3/2016 | Rudisill | ..... | H01R 13/6205 |

FOREIGN PATENT DOCUMENTS

JP 2016-048614 A 4/2016

* cited by examiner

*Primary Examiner* — Phuong K Dinh

(57) ABSTRACT

Provided are a connector and a connector assembly which can be attached for use to a bendable object of interest such as clothing. A connector, which is mated with a mating connector, is provided with a plate-shaped housing, electrically conductive contacts arranged on the housing, and a plurality of retainer members formed from a magnetic metal and arranged in the housing. When the connector is mated with the mating connector, the retainer members are attracted to a magnet that the mating connector has so as to hold the mating state. The housing is formed from a bendable insulating rubber, and the plurality of retainer members are spaced apart from each other in the longitudinal direction (the X direction) parallel to a front surface of the housing.

6 Claims, 24 Drawing Sheets

MAGNETIC CONNECTOR ARRANGED IN A BENDABLE HOUSING IN AN ELECTRICALLY CONDUCTIVE CONNECTOR ASSEMBLY

CROSS REFERENCE TO RELATED APPLICATION

The contents of the following Japanese patent application are incorporated herein by reference, Japanese Patent Application 2017-181027 filed on Sep. 21, 2017.

FIELD

The present invention relates to a connector and a connector assembly.

BACKGROUND

Already known is such an arrangement in which a connector (receptacle) and a mating connector (plug) are attracted to and thereby mated with each other under the action of a magnetic force. More specifically, the connector is provided with a magnetic metal member and the mating connector is provided with a magnet, so that the magnetic metal member and the magnet are attracted to each other so as to hold the mating state (for example, see Patent Literature 1).

Disclosed in Patent Literature 1 is a connector which employs a magnetic force to hold the state of being mated with a mating connector. This connector is provided with a plurality of contacts and magnetic metal members within a housing. The mating connector is provided, in a shell accommodated in the housing, with a plurality of contacts and a magnet. Then, when the connector is mated with the mating connector, the contacts are brought into contact with each other, and the magnet on the mating connector side and the magnetic metal members on the connector side are attracted to each other by a magnetic force, thereby holding the mating state.

CITATION LIST

Patent Literature

Patent Literature 1: Japanese Patent Application Laid-Open No. 2016-048614

SUMMARY

Technical Problem

However, in the connector disclosed in Patent Literature 1, the housing itself had a high rigidity and the magnetic metal members having a high rigidity were disposed across the entire mating surface of the connector. It was thus difficult to attach the connector to a bendable object of interest such as clothing. Furthermore, even if it was possible, the connector was not capable of following the bending of the object of interest, thereby raising concerns that the connector would be dislodged from the object of interest, the connector would damage the object of interest, or the connector would cause the person wearing the clothing to feel unpleasant.

The present invention has been made to solve the aforementioned problems. It is thus an object of the present invention to provide a connector and a connector assembly which can be attached for use to a bendable object of interest such as clothing.

Solution to Problem

In order to achieve the aforementioned object, a connector according to one aspect of the present invention is mated with a mating connector. The connector is provided with: a plate-shaped housing; an electrically conductive contact arranged on the housing; and a plurality of retainer members which are formed from a magnetic substance or magnet and arranged in the housing, and when the connector is mated with the mating connector, attracted to a magnet the mating connector has so as to hold the mating state. In this connector, the housing is formed from a bendable insulator, and the plurality of retainer members are spaced apart from each other in a predetermined direction parallel to one plate surface of the housing.

As described above, the housing of the connector according to the aspect of the present invention is formed from a bendable plate-shaped insulator, and the plurality of retainer members formed from a magnetic substance or magnet are spaced apart from each other in a predetermined direction parallel to one plate surface of the housing. This structure enables the housing of the connector to be freely bendable in a manner such that at least both ends of the housing in the predetermined direction come closer to each other. That is, the retainer members will never interfere with the bending of the housing.

This enables the connector to be readily attached with reliability to a bendable object of interest such as clothing, for example, by sewing and/or by adhesion with an adhesive. After attached, the connector will be impervious to being dislodged, and never cause the object of interest to be damaged and the user to feel unpleasant. As described above, the connector of one aspect of the present invention addresses the problem that the connector can be attached for use to a bendable object of interest such as clothing.

Furthermore, the contact of the connector of one aspect of the present invention is preferably formed as a coating layer of an electrically conductive ink along a portion from the one plate surface of the housing through a side surface thereof to an opposite plate surface thereof.

When the connector is sewn on and attached to an object of interest such as clothing, this structure permits the sewing across the contact. Being capable of sewing without the need of avoiding the contact facilitates the attachment of the connector to the object of interest.

Furthermore, it is not necessary to ensure an extra sewing region on the housing to avoid the contact. Therefore, it is possible to achieve a compact connector that can be sewn on and attached to an object of interest.

Furthermore, the contact of the connector of one aspect of the present invention may also be formed from an electrically conductive rubber that penetrates through the housing.

When the connector is sewn on and attached to an object of interest such as clothing, this structure permits the sewing across the contact. Being capable of sewing without the need of avoiding the contact facilitates the attachment of the connector to the object of interest. Furthermore, it is not necessary to ensure an extra sewing region to avoid the contact, and the housing needs not to be increased in size more than necessary. Furthermore, the connector provides an increased degree of flexibility in design because the contact can be disposed not only on and near the edge portion of a plate surface of the housing but also at any place.

Furthermore, the connector of one aspect of the present invention may also be configured such that a groove along which the connector is sewn on an object of interest is formed in the one plate surface of the housing.

This structure allows the sewing thread for sewing the connector on the object of interest such as clothing to be accommodated within the groove. Thus, when the connector is mated with the mating connector, the sewing thread will never interfere with the mating.

Furthermore, the connector of one aspect of the present invention is configured such that on the one plate surface of the housing, the contact may also have a concaved surface portion to be sewn on an object of interest with an electrically conductive sewing thread.

This structure allows the contact of the connector and the electrically conductive pattern of an object of interest such as clothing to be sewn together with the electrically conductive sewing thread, thereby electrically connecting both together with greater reliability. Furthermore, the sewing thread for sewing the connector on the object of interest is accommodated within the concaved surface portion. Thus, when the connector is mated with the mating connector, the electrically conductive sewing thread will never interfere with the mating.

Furthermore, a connector assembly of one aspect of the present invention is provided with any one of the connectors described above and a mating connector to be mated with the connector. In the connector assembly, the mating connector is provided with a mating-side housing, an electrically conductive mating contact provided to the mating side housing, and a mating-side retainer member having a magnet provided to the mating-side housing; and when the connector and the mating connector are mated with each other, the contact and the mating contact are brought into contact with each other, and the retainer members and the mating-side retainer member are attracted to each other by a magnetic force, thereby holding the mating state.

According to one aspect of the present invention, it is possible to provide a connector and a connector assembly which can be attached for use to a bendable object of interest such as clothing.

DESCRIPTION OF EMBODIMENTS

Figure 1A:
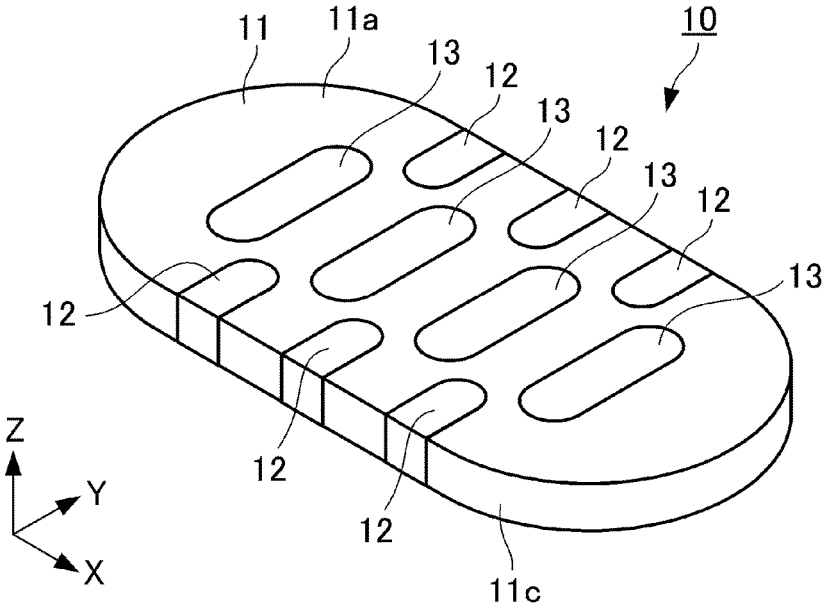
FIG. 1A is a perspective view illustrating a connector according to a first embodiment of the present invention.

With reference to the accompanying drawings, a description will be given of connectors according to embodiments of the present invention.

First Embodiment

As illustrated in FIGS. 1A and 1B and FIGS. 2A, 2B, and 2C, a connector 10 according to a first embodiment of the present invention is provided with a plate-shaped housing 11, electrically conductive contacts 12 arranged on the housing 11, and retainer members 13 formed from a magnetic substance and arranged in the housing 11. As will be described in greater detail later, when the connector 10 is mated with a mating connector 20, the retainer members 13 hold a mating state by a magnetic force.

Figure 3A:
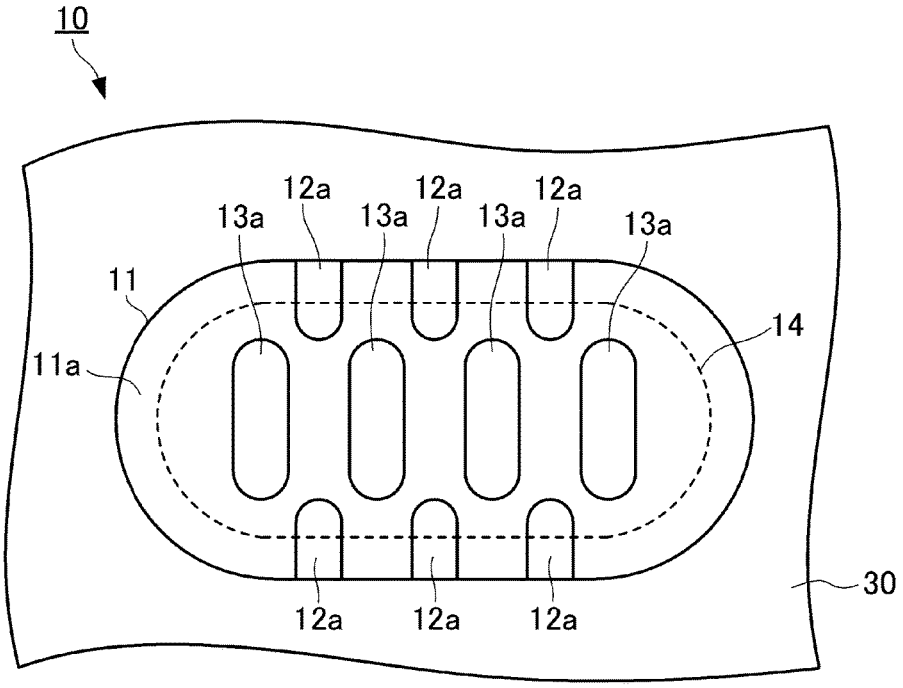
FIG. 3A is an explanatory view illustrating the connector of FIGS. 1A and 1B sewn on clothing.

As illustrated in FIG. 3A, the connector 10 is used in a state where the peripheral edge of the housing 11 is sewn on a clothing 30 (an object of interest) with an insulating sewing thread 14. An electrically conductive pattern is formed on the clothing 30 with an electrically conductive ink, for example. The electrically conductive pattern of the clothing 30 is electrically connected to the contacts 12 (contact parts 12*b*) of the connector 10 that has been sewn on the clothing 30. That is, by the connector 10 sewn on the clothing 30 being mated with the mating connector 20, the electrically conductive pattern of the clothing 30 connected to the connector 10 and the conductor (an electric wire 28) connected to the mating connector 20 are electrically connected to each other.

In this embodiment, the connector 10 is sewn on the clothing 30. However, the connector 10 may also be attached to the clothing 30 by an adhesive or may also be attached by an adhesive to and sewn on the clothing 30 in combination.

In this embodiment, the connector 10 is a receptacle and the mating connector 20 is a plug, but without being limited thereto, the connector 10 may also be a plug and the mating connector 20 may also be a receptacle. A description will next be given of each component of the connector 10.

(Housing)

Figure 4A:
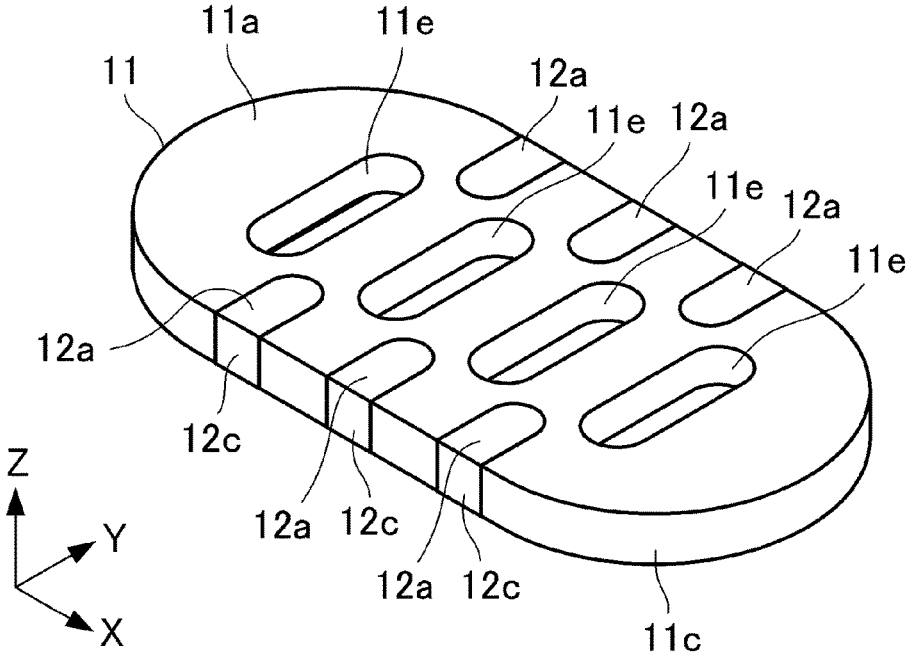
FIG. 4A is a perspective view illustrating the connector of FIGS. 1A and 1B from which retainer members have been removed.
Figure 4B:
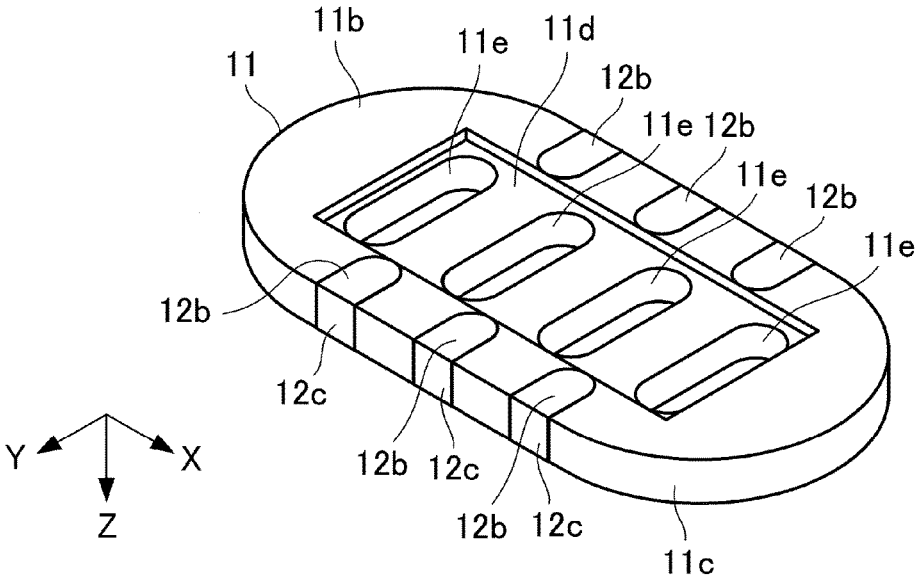
FIG. 4B is a perspective view as seen from the bottom side of the connector of FIGS. 1A and 1B from which retainer members have been removed.

As illustrated in FIGS. 4A and 4B, the housing 11 is formed from a bendable plate-shaped insulator (for example, rubber or elastomer). The housing 11 has arc-shaped ends in the longitudinal direction (the X direction) of the plate. This makes the clothing 30 impervious to being damaged by the housing 11 with the connector 10 attached to the clothing 30. Furthermore, the housing 11 has four through holes 11*e* formed at equal intervals at the center of the plate width (in the Y direction) in the longitudinal direction (the X direction). The housing 11 has a rectangular recessed portion 11*d* formed on a rear surface 11*b* thereof, and in the recessed portion 11*d*, the openings of the four through holes 11*e* are disposed at equal intervals.

The housing 11 according to this embodiment is a plate-shaped member with arc-shaped ends, but the housing is not limited to this shape. The housing 11 may be formed in any shape such as a circular shape, an elliptical shape, or a rectangular shape as seen in plan view. However, to prevent the clothing 30 from being damaged, the housing 11 may preferably be shaped without any acute corner. Furthermore, although the housing 11 is not necessarily shaped to be flat, an appropriately thinner portion to be sewn on an object of interest would preferably facilitate sewing.

(Retainer Member)

The retainer member 13 is formed from a magnetic metal (for example, stainless steel having magnetism). When the connector 10 is mated with the mating connector 20, the retainer members 13 hold a mating state by being attracted to a magnet 24 the mating connector 20 has. Furthermore, the retainer members 13 have a higher rigidity than the housing 11, and act to maintain the form of the connector 10.

Figure 5A:
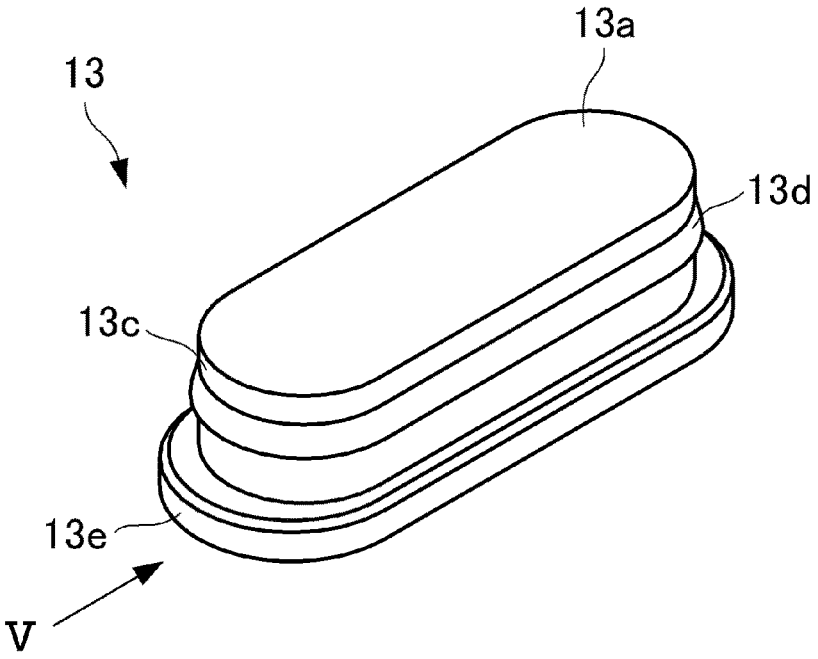
FIG. 5A is a perspective view illustrating the retainer member of FIGS. 1A and 1B.
Figure 5B:
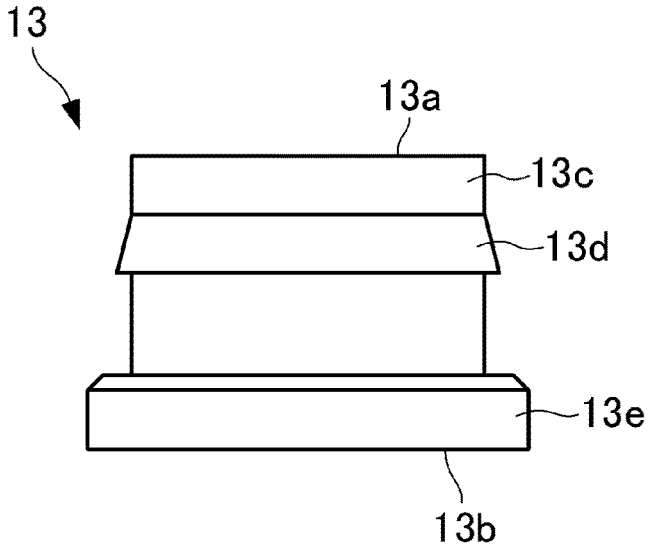
FIG. 5B is a side view as seen from the direction of arrow V of FIG. 5A.
Figure 6A:
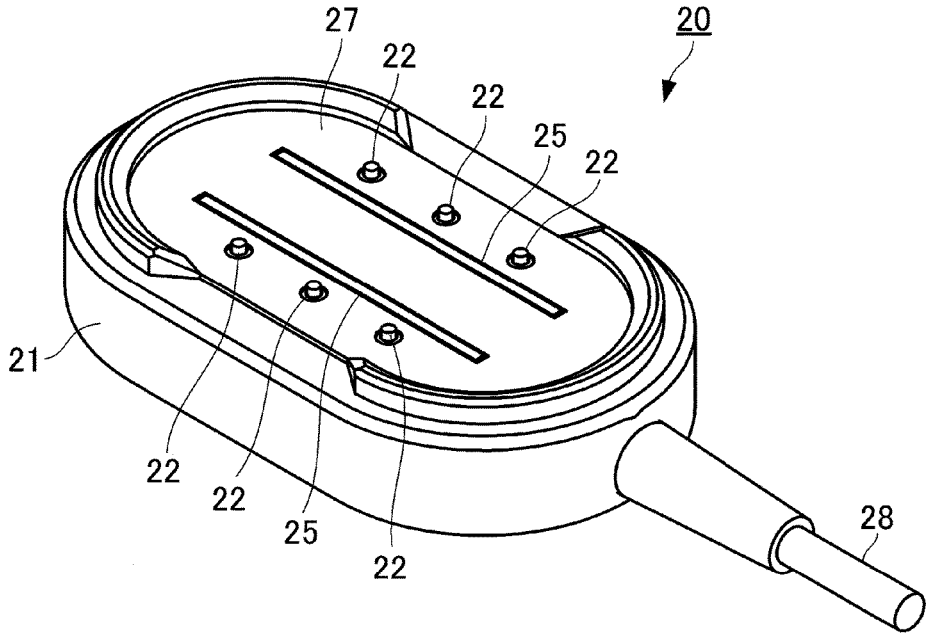
FIG. 6A is a perspective view illustrating a mating connector according to the first embodiment of the present invention.
Figure 6B:
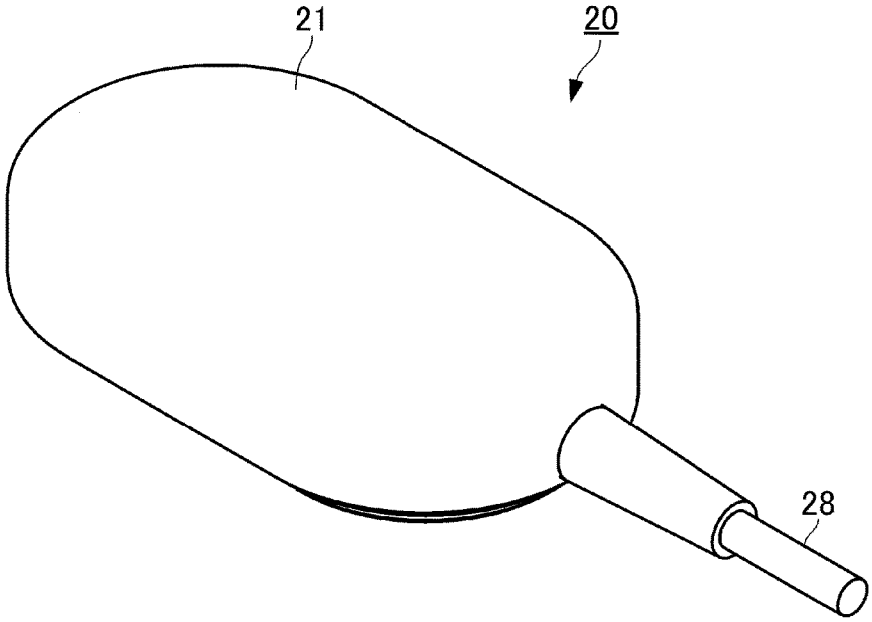
FIG. 6B is a perspective view as seen from the bottom side of the mating connector.
Figure 7A:
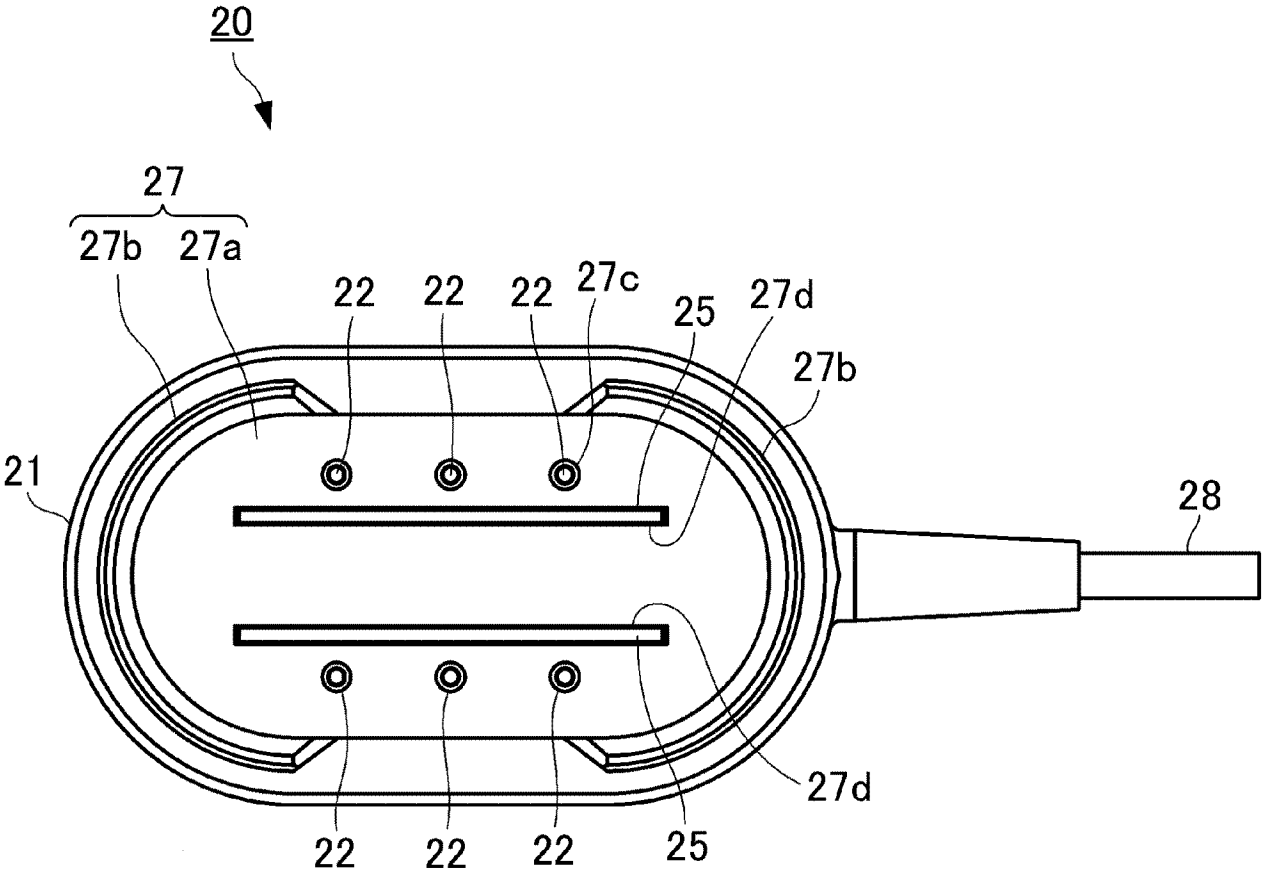
FIG. 7A is a plan view illustrating the mating connector illustrated in FIGS. 6A and 6B.
Figure 7B:
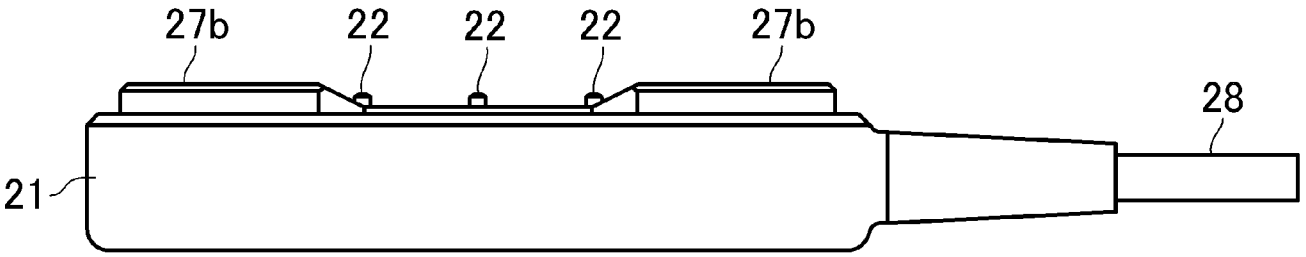
FIG. 7B is a side view of the mating connector illustrated in FIGS. 6A and 6B.

As illustrated in FIGS. 5A and 5B, the retainer member 13 has a main body 13*c*, and an annular projected portion 13*e* formed at the lower end thereof. The main body 13*c* has an elongated upper surface 13*a* with rounded ends. At about the middle of the side peripheral surface of the main body 13*c*, there is formed an annular projected portion 13*d* which has an inclined side peripheral surface, so that the retainer member 13 is prevented from being dislodged when mounted in the through holes 11*e*.

Figure 1B:
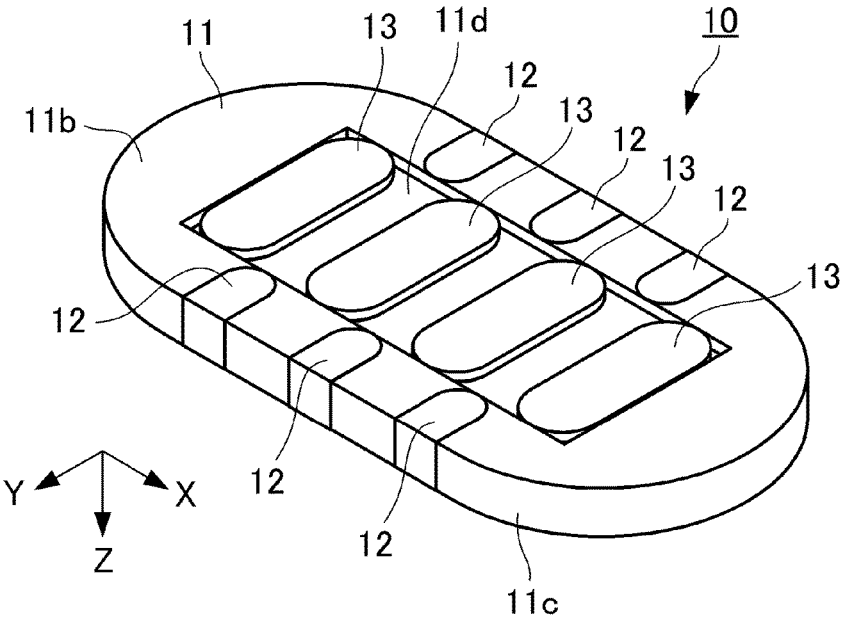
FIG. 1B is a perspective view taken from the bottom side of the connector.
Figure 2A:
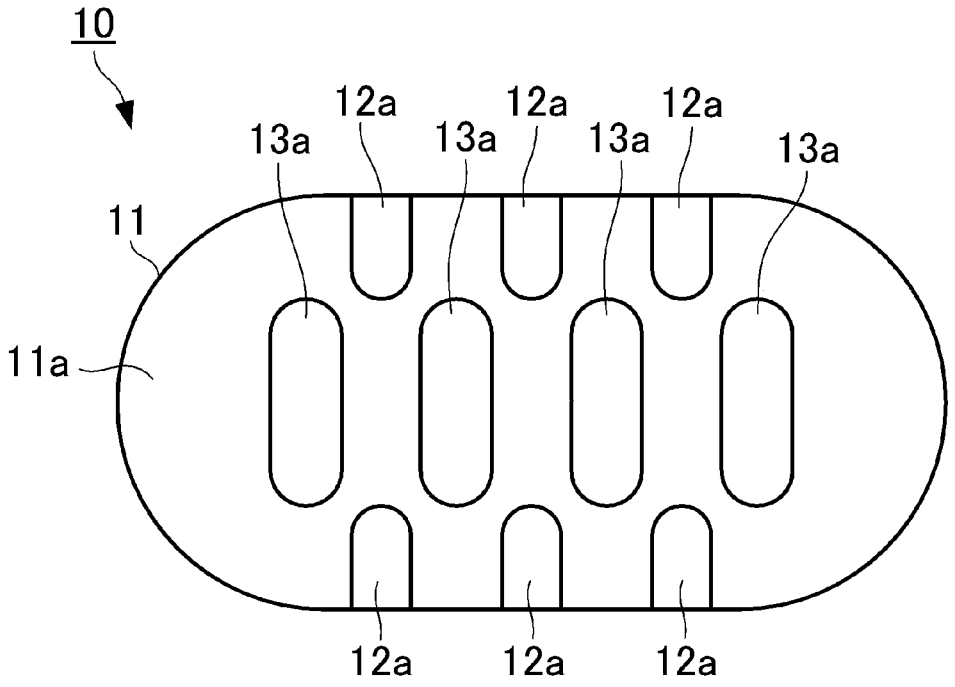
FIG. 2A is a plan view illustrating the connector of FIGS. 1A and 1B.
Figure 2B:
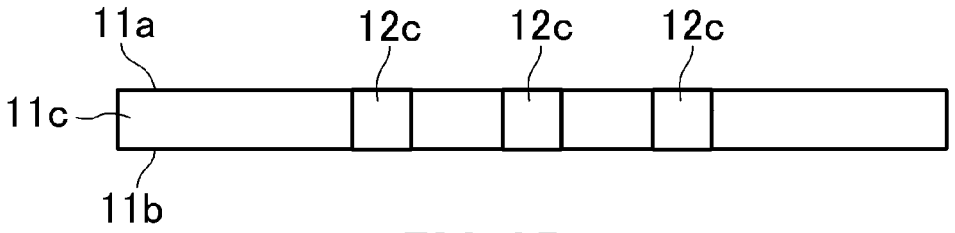
FIG. 2B is a side view of the connector of FIGS. 1A and 1B.
Figure 2C:
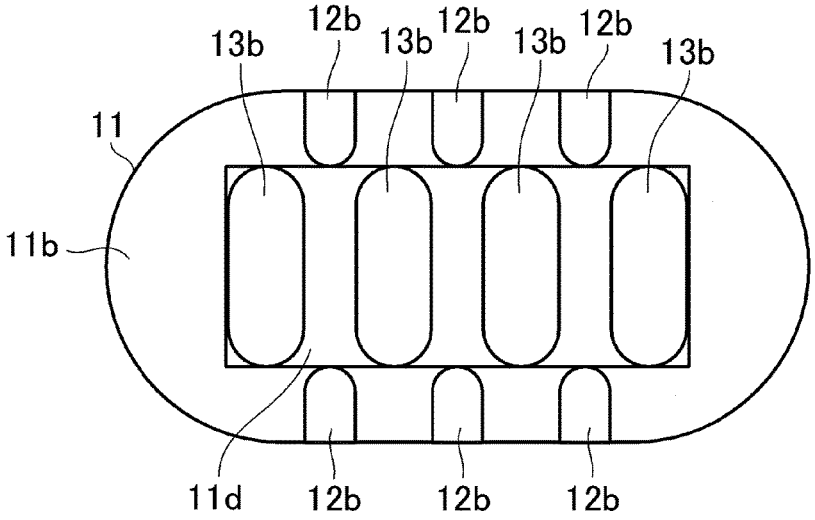
FIG. 2C is a bottom view of the connector of FIGS. 1A and 1B.
Figure 3B:
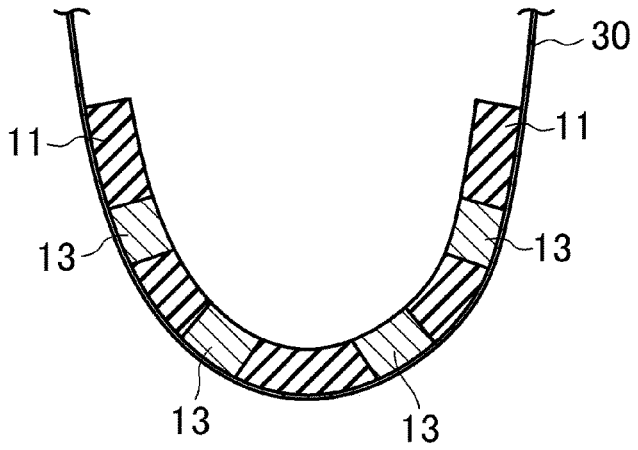
FIG. 3B is a cross-sectional view illustrating the connector sewn on the clothing being bent.

As illustrated in FIGS. 1A and 1B, the four retainer members 13 are spaced apart from each other in a predetermined direction (in the X direction of FIGS. 1A and 1B) parallel to a front surface 11*a* (one plate surface) of the housing 11. As illustrated in FIG. 3B, this enables the housing 11 of the connector 10 to be freely bendable in a manner such that at least both ends of the housing 11 in the predetermined direction (the X direction) come closer to each other.

In this embodiment, although the retainer members 13 are formed from a magnetic metal, but without being limited thereto, may also be formed from a magnet. Furthermore, in this embodiment, the upper surface 13*a* of the retainer member 13 is exposed from the front surface 11*a* of the housing 11, but without being limited thereto, the retainer member 13 may also be embedded in the housing 11. Furthermore, the number of the retainer members 13 is not limited to four, but may also be any number equal to two or greater.

Furthermore, in this embodiment, the retainer members 13 are disposed in one row, but may also be disposed in a plurality of rows, i.e., in two rows or greater. For example, it is also acceptable that a plurality of retainer members 13 are spaced apart from each other in the X direction of FIGS. 1A and 1B and spaced apart from each other also in the Y direction. Furthermore, in this embodiment, a plurality of retainer members 13 are disposed at equal intervals, but may also be disposed at different intervals.

(Contact)

As illustrated in FIGS. 1A and 1B and FIGS. 2A, 2B, and 2C, the contacts 12 are formed as a coating layer of an electrically conductive ink along the portion from the front surface 11*a* of the housing 11 to the rear surface 11*b* along a side surface 11*c*. For example, the coating layer has a thickness of 30 to 50 μm.

More specifically, the contacts 12 are provided with six contact parts 12*a* in the rows on both side edge portions of the front surface 11*a* of the housing 11. On the rear surface 11*b* of the housing 11, six contact parts 12*b* in the rows are formed on both side edge portions. Furthermore, there are six connections 12*c* that are coated on the side surface 11*c* of the housing 11 with an electrically conductive ink. Then, the contact parts 12*a* on the front surface 11*a* of the housing 11 are connected to the contact parts 12*b* of the rear surface 11*b* via the six connections 12*c*, respectively.

(Mating Connector)

A description will next be given of the mating connector 20 to be mated with the connector 10.

As illustrated in FIGS. 6A and 6B and FIGS. 7A and 7B, the mating connector 20 is provided with a mating-side housing 21, a shell 27, electrically conductive mating contacts 22 provided in the mating-side housing 21, and mating-side retainer members 23 (see FIG. 8) formed from the magnet 24 and provided in the mating-side housing 21. Then, when the connector 10 and the mating connector 20 are mated, the contacts 12 and the mating contacts 22 are brought into contact with each other, and the retainer members 13 of the connector 10 and the mating-side retainer members 23 of the mating connector 20 are attracted to each other by a magnetic force, thereby holding a mating state.

Figure 8:
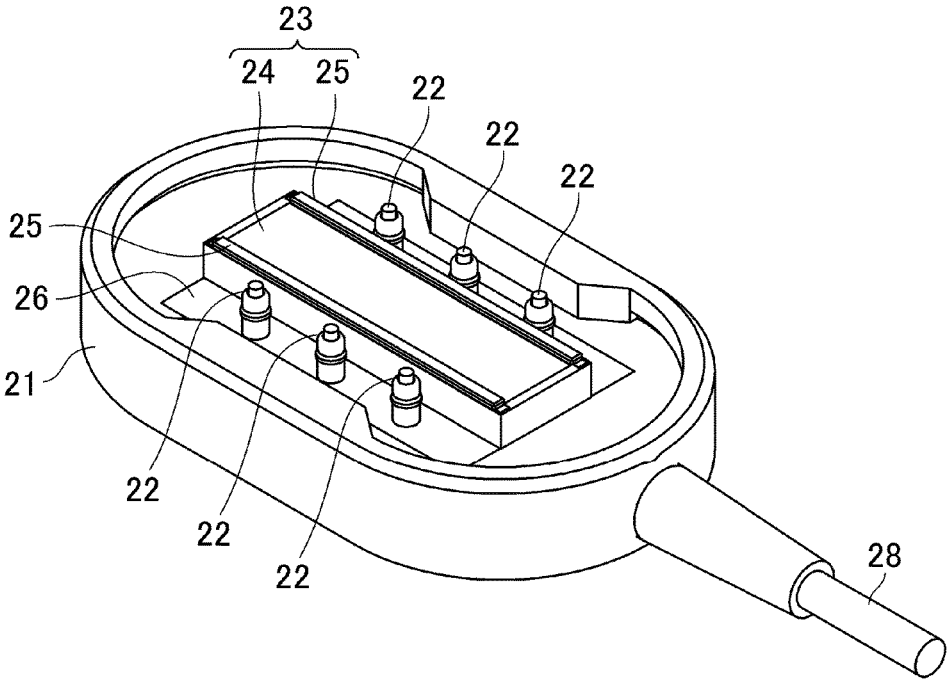
FIG. 8 is a perspective view illustrating the mating connector illustrated in FIGS. 6A and 6B from which a shell has been removed.
Figure 9A:
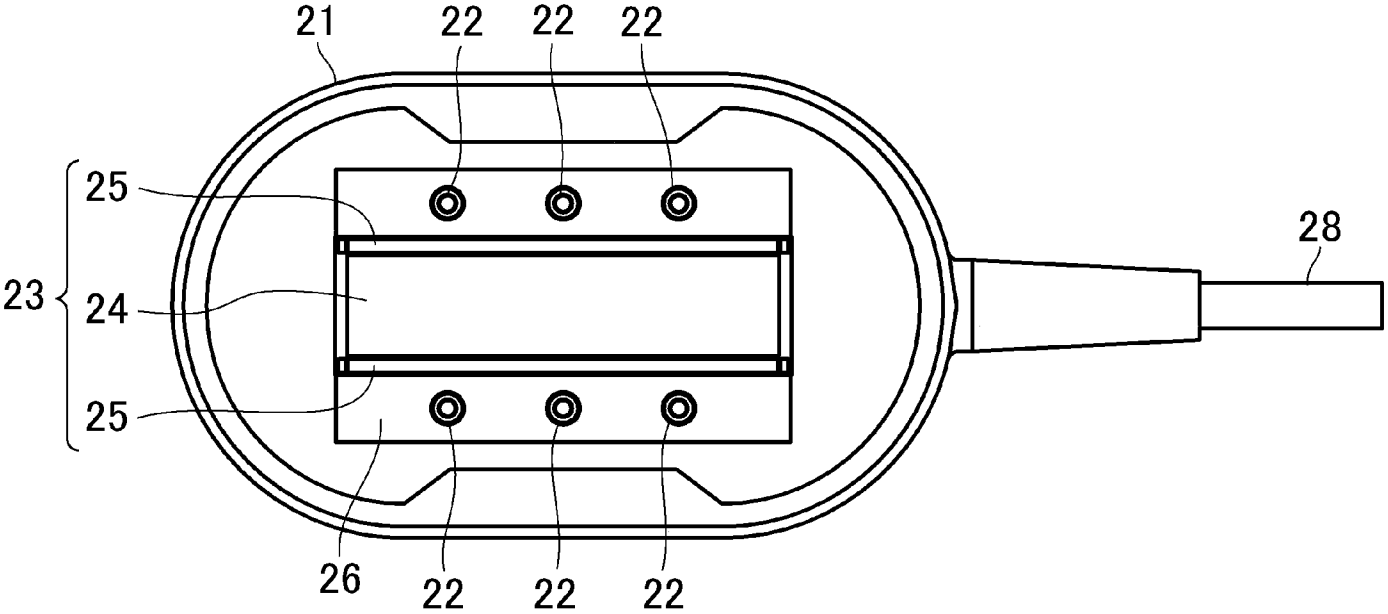
FIG. 9A is a plan view illustrating the mating connector (without the shell) illustrated in FIG. 8.
Figure 9B:
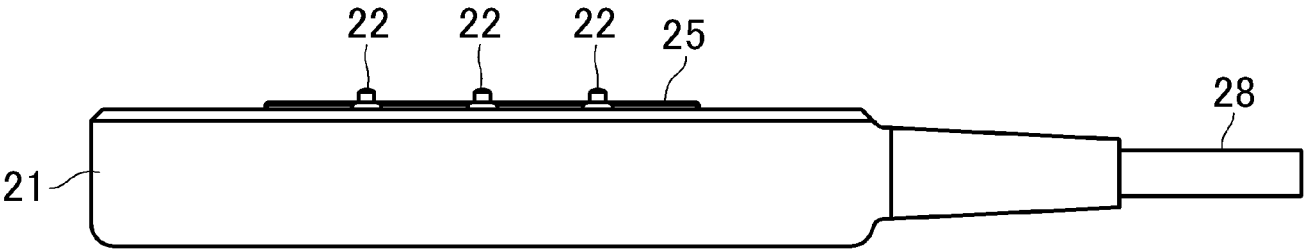
FIG. 9B is a side view of the mating connector (without the shell) illustrated in FIG. 8.

FIG. 8 and FIGS. 9A and 9B illustrate the mating connector 20 with the shell 27 removed. The housing 21 is a container formed from an insulator (for example, an insulating resin) with the upper surface opened.

The mating contact 22 is a Pogo pin which has a spring incorporated therein and can resiliently be in contact with the contact 12 of the connector 10. The mating contacts 22 are arranged such that three contacts are disposed in each of two rows on a substrate 26, so as to be capable of being connected to the contacts 12 of the connector 10 when the connectors are mated with each other. The mating contacts 22 are electrically connected to an electric wire 28 through the conductors provided on the substrate 26.

Figure 10A:
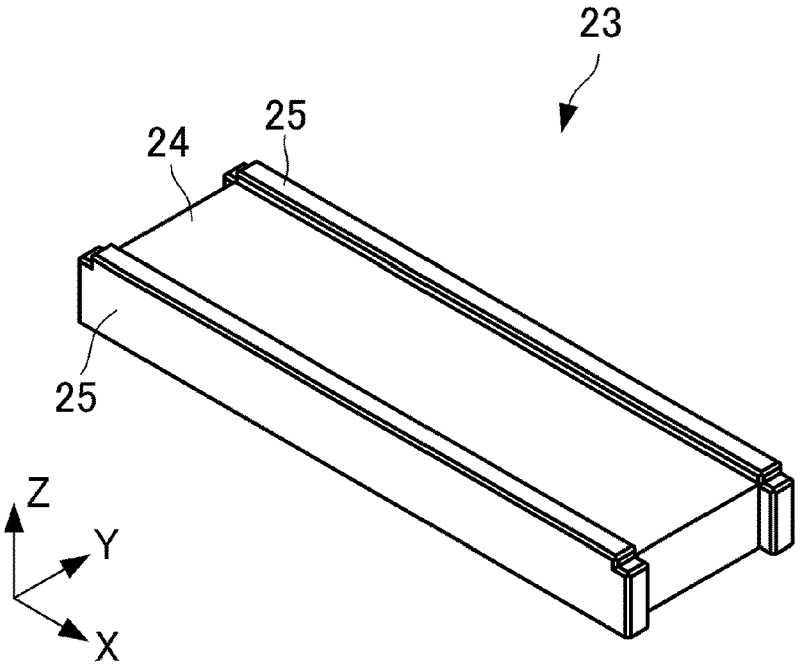
FIG. 10A is a perspective view illustrating a mating-side retainer member of FIGS. 9A and 9B.
Figure 10B:
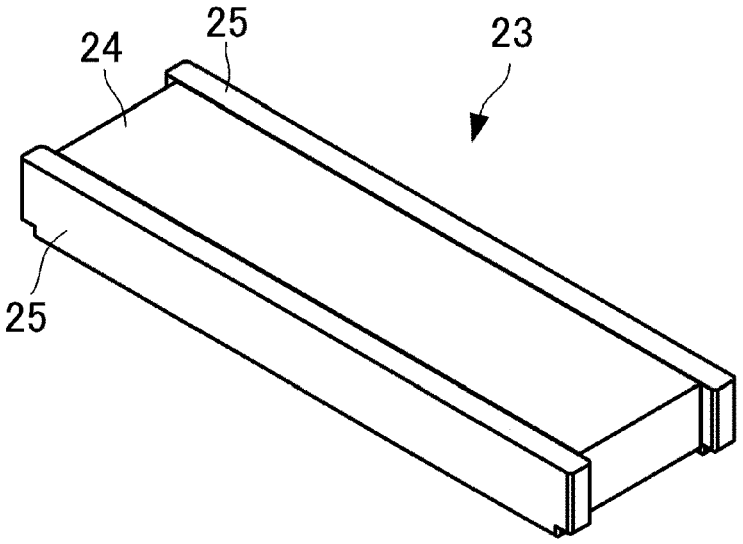
FIG. 10B is a perspective view as seen from the bottom side of the mating-side retainer member of FIGS. 9A and 9B.

As illustrated in FIGS. 10A and 10B, the mating-side retainer member 23 has a rectangular parallelepiped magnet 24, and plate-shaped yokes 25 which are provided on both sides of the magnet 24. For example, the yoke 25, which is formed from magnetic stainless steel, is slightly protruded from the upper surface of the magnet 24 in the Z direction of the figure, and increases the magnetic force of the magnet 24 and protects the magnet 24. As illustrated in FIGS. 9A and 9B, the mating-side retainer members 23 are accommodated in the housing 21 while being attached to the substrate 26.

As illustrated in FIGS. 6A and 6B and FIGS. 7A and 7B, the shell 27, which is formed from an insulator, has a bottom plate part 27*a* and guide parts 27*b*, 27*b* provided on both ends thereof. The bottom plate part 27*a* has generally the same shape as that of the housing 11 on the connector 10 side as seen in plan view, and a guide part 27*b* is curved in the shape of a semicircular arc as seen in plan view. The bottom plate part 27*a* is provided with through holes 27*c* corresponding to the mating contacts 22, so that the mating contacts 22 are protruded from the through holes 27*c*. Furthermore, the bottom plate part 27*a* has elongated holes 27*d* formed corresponding to the yokes 25, so that the yokes 25 are protruded from the elongated holes 27*d*.

When the connector 10 and the mating connector 20 are mated with each other, this allows the housing 11 of the connector 10 to be guided by the shell 27 of the mating connector 20, and the connector 10 to be mated with an appropriate portion of the mating connector 20.

(Connector Assembly)

A description will next be given of a connector assembly 1.

Figure 11A:
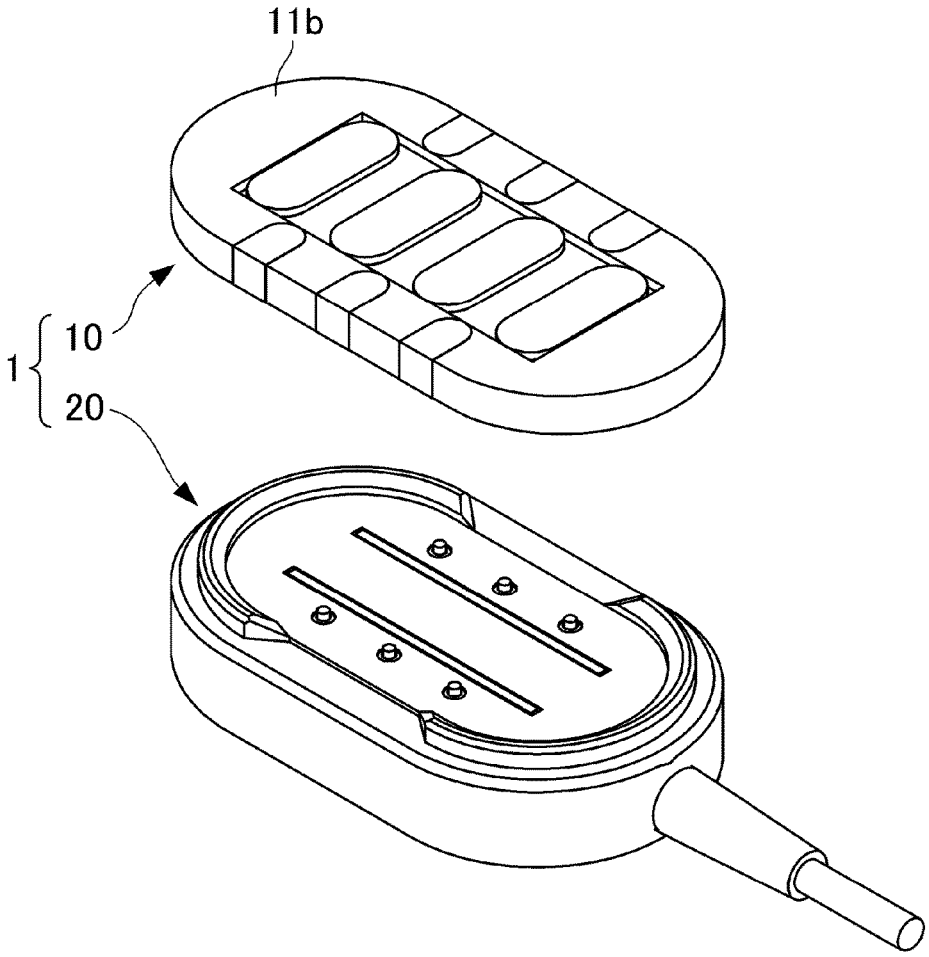
FIG. 11A is a perspective view illustrating the connector of FIGS. 1A and 1B and the mating connector of FIGS. 6A and 6B not yet mated with each other.
Figure 11B:
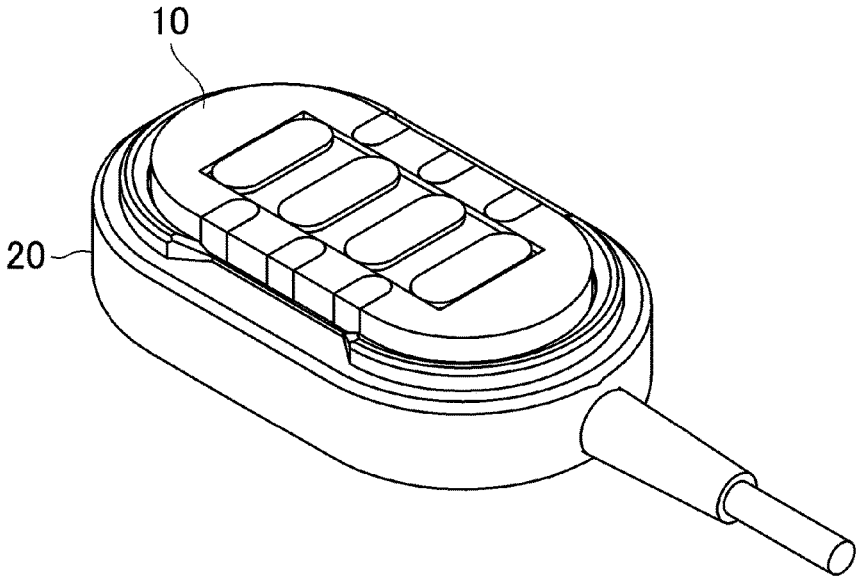
FIG. 11B is a perspective view illustrating both the connectors of FIGS. 6A and 6B having been mated with each other.

As illustrated in FIGS. 11A and 11B, the connector assembly 1 has the connector 10 and the mating connector 20. FIG. 11A is a perspective view illustrating the connector 10 and the mating connector 20 not yet mated with each other, and FIG. 11B is a perspective view illustrating both the connecters having been mated with each other.

As illustrated in FIG. 11A, part of the rear side of the connector 10 is guided by the guide parts 27*b* to be fitted (accommodated) into the shell 27 of the mating connector 20. As illustrated in FIG. 12B, with the connector 10 and the mating connector 20 mated with each other, the contact parts 12*a* of the contacts 12 on the connector 10 side are each in contact with the corresponding upper end contact part of the mating contacts 22 on the mating connector 20 side. Furthermore, each of the retainer members 13 on the connector 10 side is disposed so as to straddle the two yokes 25 on the mating connector 20 side. That is, the magnet 24 and the yokes 25 of the mating connector 20 and the retainer members 13 of the connector 10 form one closed magnetic circuit. This allows each of retainer members 13 to be strongly attracted to the magnet 24 and the yokes 25.

A description will next be given of actions and effects of the embodiment of the present invention.

As described above, the housing 11 of the connector 10 according to this embodiment is formed from a plate-shaped bendable insulating rubber. In this housing 11, the plurality of retainer members 13 formed from a magnetic metal are spaced apart from each other in a predetermined direction (in the X direction of FIGS. 1A and 1B) parallel to the front surface 11*a* of the housing 11. This arrangement enables the housing 11 of the connector 10 to be freely bendable in a manner such that at least both ends of the housing 11 in the predetermined direction (the X direction) come closer to each other (see FIG. 3B). That is, the retainer members 13 will never interfere with the bending of the housing 11.

This enables the connector 10 to be readily attached with reliability to a bendable object of interest such as clothing, for example, by adhesion with an adhesive and/or by sewing with thread. Furthermore, during use after attached, the connector 10 will be impervious to being dislodged, the object of interest will be impervious to being damaged by the connector 10, and the connector 10 will never make the user feel unpleasant.

Furthermore, the contacts 12 of the connector 10 according to this embodiment are formed as a coating layer of an electrically conductive ink. When the connector 10 is sewn on and thereby attached to an object of interest such as clothing, this permits the sewing across the contacts 12. Being capable of sewing without the need of avoiding the contacts 12 facilitates the attachment of the connector 10 to the object of interest.

Furthermore, since it is not necessary to ensure an extra sewing region to avoid the contacts 12, the housing 11 needs not to be increased in size more than necessary. Therefore, it is possible to achieve a compact connector 10 that can be sewn on and attached to an object of interest such as clothing.

Second Embodiment

A description will next be given of a second embodiment.

The second embodiment is different from the first embodiment in that contacts 42 are formed from an electrically conductive rubber, whereas the contacts 12 are formed from a coating layer of an electrically conductive ink. The other components are the same as those of the first embodiment, and descriptions thereof will be omitted as appropriate.

Figure 12A:
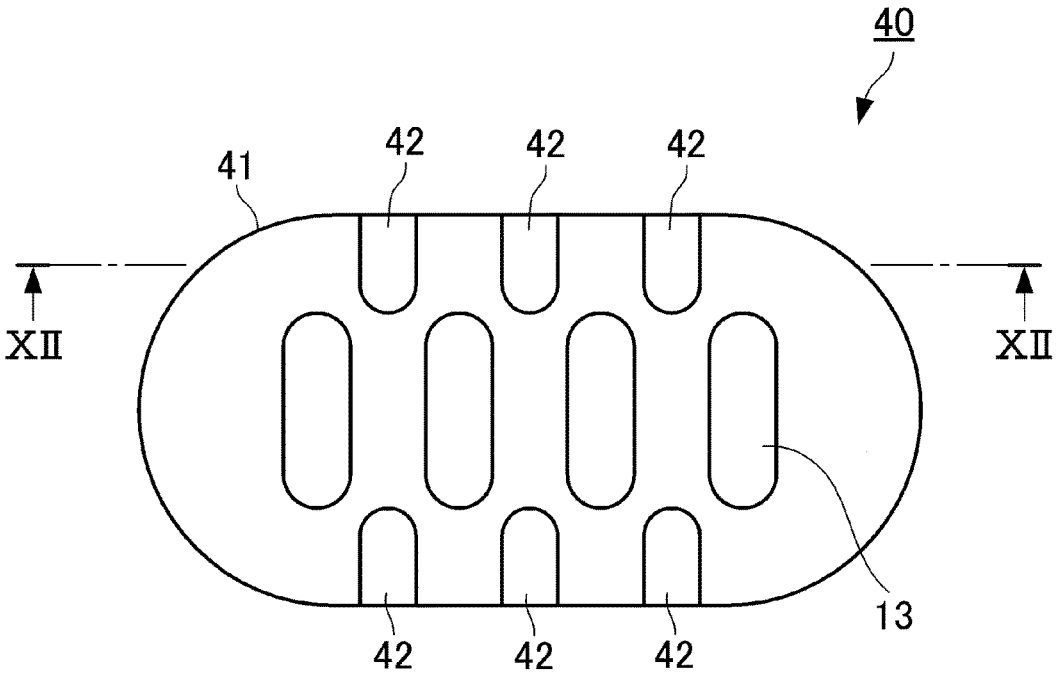
FIG. 12A is a plan view illustrating a connector according to a second embodiment of the present invention.
Figure 12B:
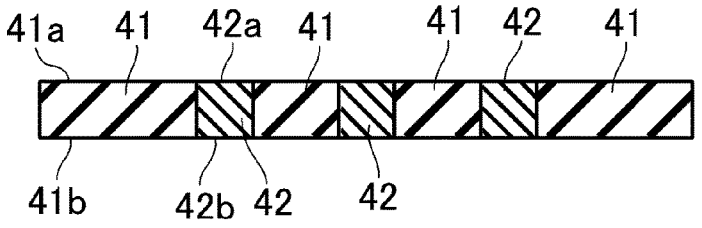
FIG. 12B is a cross-sectional view taken along line XII-XII of FIG. 12A.

As illustrated in FIG. 12A, a connector 40 according to this embodiment is provided with a plate-shaped housing 41 formed from an insulating rubber, the contacts 42 formed from an electrically conductive rubber, and the retainer members 13 formed from a magnetic metal. As illustrated in FIG. 12B, the contacts 42 penetrate the plate-shaped housing 41 and extend in a direction perpendicular to the plate surface.

More specifically, the upper surface 42*a* of the contacts 42 is exposed from a front surface 41*a* of the housing 41, and acts as a contact part to come into contact with the mating contacts 22 of the mating connector 20. A lower surface 42*b* of the contacts 42 is exposed from a rear surface 41*b* of the housing 41, and acts as a contact part to come into contact with an electrically conductive pattern that is formed on an object of interest such as clothing. The housing 41 and the contacts 42 can be integrally molded.

When the connector 40 is sewn on and attached to an object of interest such as clothing, this structure enables the connector 40 to be sewn across the contacts 42 as in the first embodiment. Furthermore, the connector 40 provides an increased degree of flexibility in design because the contacts 42 can be disposed not only on and near the edge portion of the front surface 41*a* of the housing 41 but also at any place of the front surface 41*a* of the housing 41.

Third Embodiment

A description will next be given of a third embodiment.

The third embodiment is different from the first and second embodiments in that sewing grooves 55A to 55D are formed in the surface of the housing. The other components are the same as those of the first or second embodiment, and descriptions thereof will be omitted as appropriate.

Figure 13A:
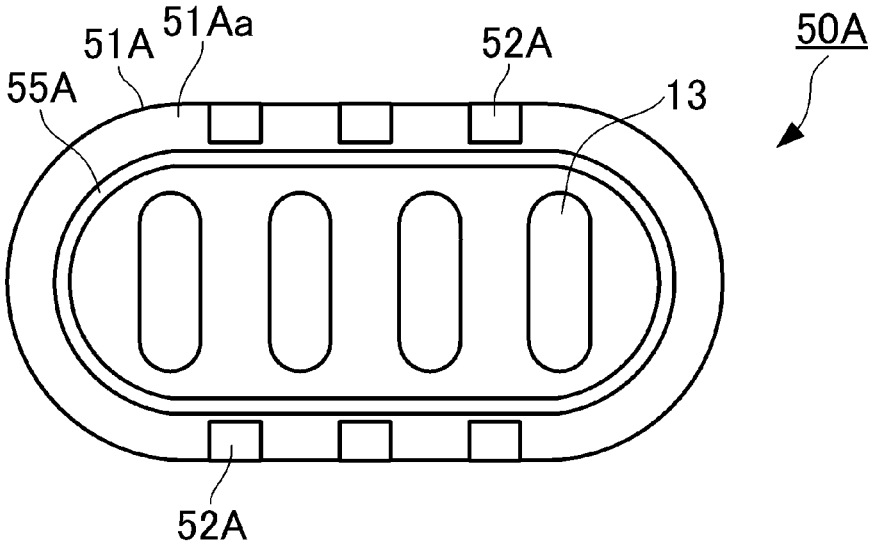
FIG. 13A is a plan view illustrating a connector according to a third embodiment of the present invention.

As illustrated in FIG. 13A, a connector 50A according to this embodiment is configured such that a groove 55A along which the connector 50A is sewn on an object of interest (for example, clothing) is formed on a front surface 51Aa of a housing 51A. That is, the groove 55A has a concave that is recessed from the front surface 51Aa of the housing 51A. This structure allows the sewing thread for sewing the connector 50A on the object of interest to be accommodated within the groove 55A. Thus, when the connector 50A is mated with the mating connector 20, the sewing thread will never interfere with the mating.

Figure 13B:
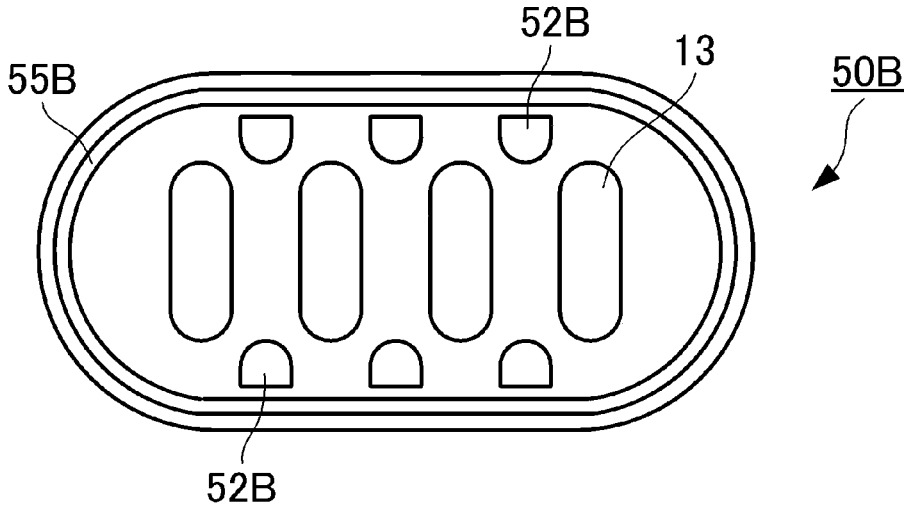
FIG. 13B illustrates a modified example of the connector according to the third embodiment of the present invention.
Figure 13C:
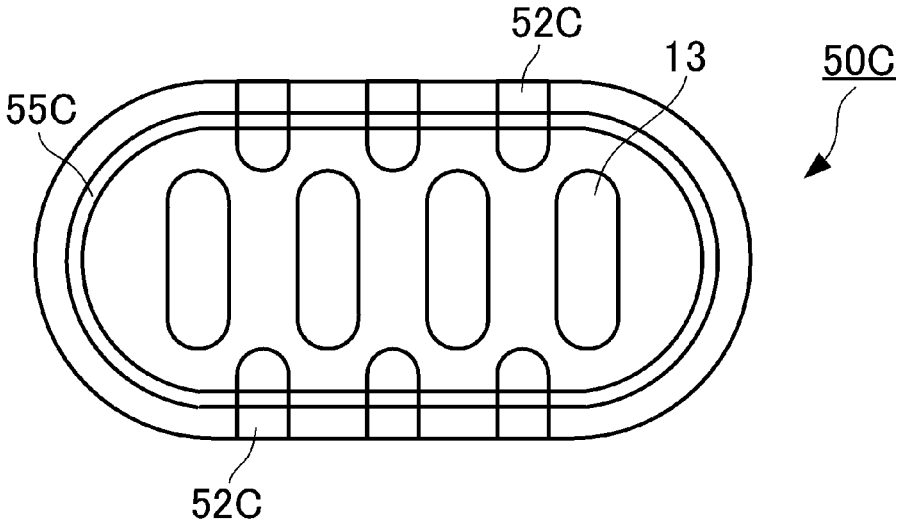
FIG. 13C illustrates a modified example of the connector according to the third embodiment of the present invention.
Figure 13D:
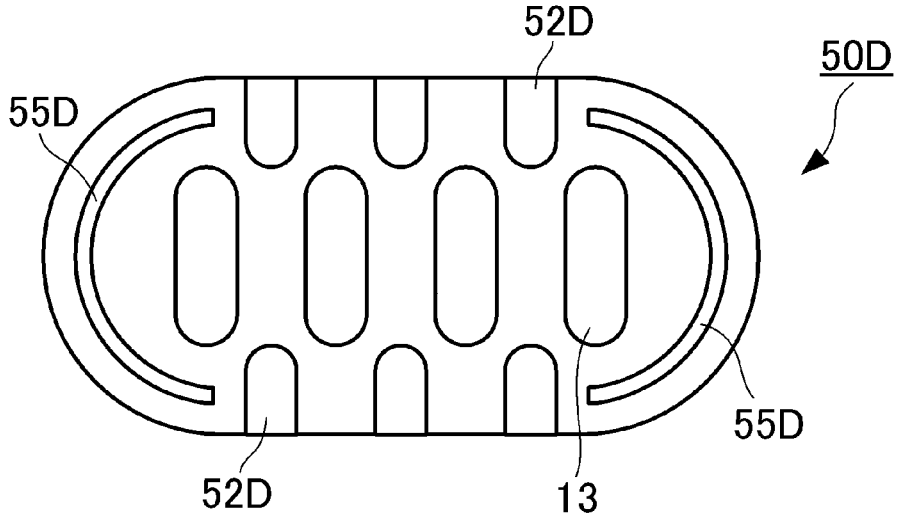
FIG. 13D illustrates a modified example of the connector according to the third embodiment of the present invention.

FIG. 13B to FIG. 13D each illustrate a modified example of this embodiment.

FIG. 13B illustrates the structure in which a sewing groove 55B is formed outside contacts 52B and the retainer members 13. In this case, like the second embodiment, the contacts 52B are formed from an electrically conductive rubber.

FIG. 13C illustrates the structure in which a sewing groove 55C intersects contacts 52C. In this structure, a coating layer of an electrically conductive ink is formed also at the intersection between the contacts 52C and the groove 55C. That is, the coating layer for forming the contacts 52C is not separated by the groove 55C. Furthermore, FIG. 13D illustrates the structure in which a sewing groove 55D is formed on each of both ends of a housing 51D.

Fourth Embodiment

A description will next be given of a fourth embodiment.

The fourth embodiment is different from the first embodiment in that contacts have a concaved surface portion to be sewn on an object of interest with an electrically conductive sewing thread. The other components are the same as those of the first embodiment, and descriptions thereof will be omitted as appropriate.

Figure 14A:
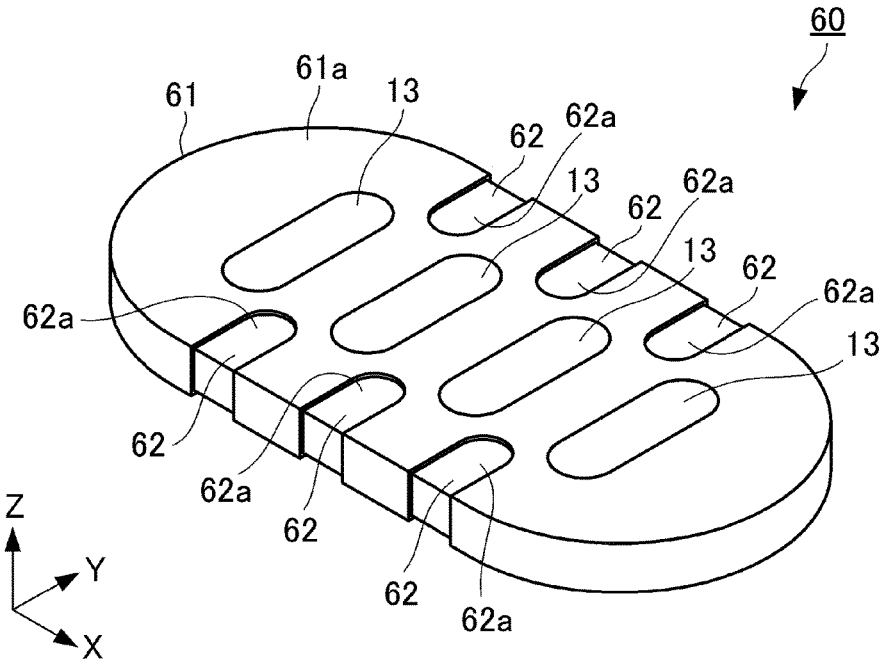
FIG. 14A is a perspective view illustrating a connector according to a fourth embodiment of the present invention.

As illustrated in FIG. 14A, a connector 60 according to this embodiment is provided with a plate-shaped housing 61 formed from an insulating rubber, electrically conductive contacts 62, and the retainer members 13 formed from a magnetic metal. The contacts 62 are formed from a coating layer of an electrically conductive ink. On a front surface 61*a* of the housing 61, the contacts 62 each have a concaved surface portion 62*a* to be sewn on the clothing 30 with an electrically conductive sewing thread 64. That is, the concaved surface portion 62*a* of the contacts 62 is formed to be recessed from the front surface 61*a* of the housing 61. More specifically, the portions of the housing 61 in which the contacts 62 are formed have a concaved shape, and a coating layer of an electrically conductive ink is formed in the portions.

Figure 14B:
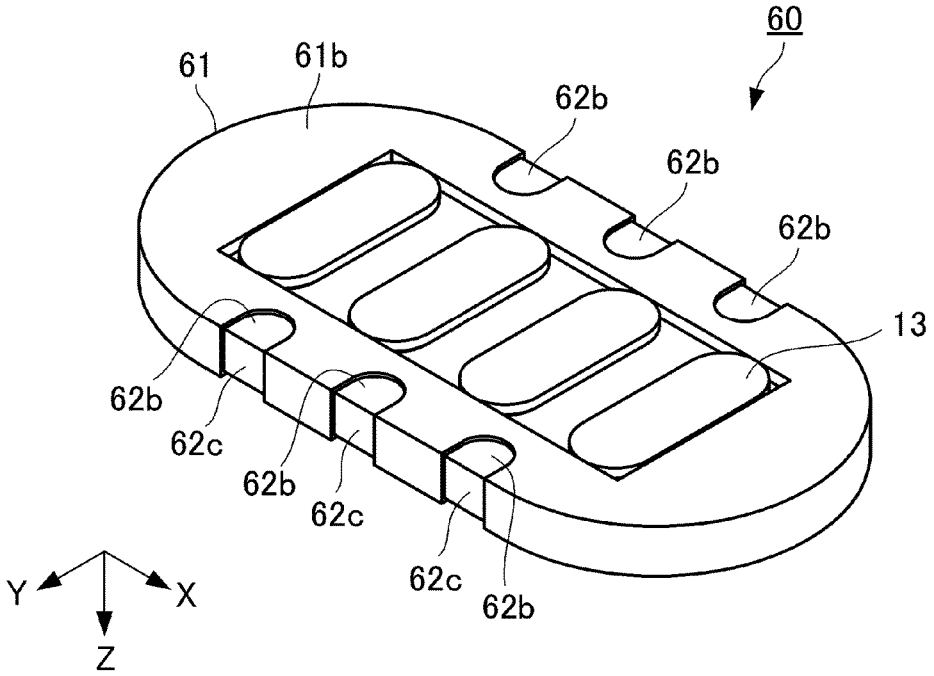
FIG. 14B is a perspective view as seen from the bottom side of the connector according to the fourth embodiment of the present invention.

Furthermore, as illustrated in FIG. 14B, a rear surface 61*b* of the housing 61 is also configured such that the contacts 62 each have a concaved surface portion 62*b* recessed from the rear surface 61*b*. The portion connecting between the concaved surface portion 62*a* and the concaved surface portion 62*b* of the contact 62 also has a concaved side surface portion 62*c* recessed from a side surface 61*c* of the housing 61. That is, the entirety of the contact 62 is formed in the portion recessed from the outer surface of the housing 61. This makes the contacts 62 impervious to being damaged by an external object.

Figure 15:
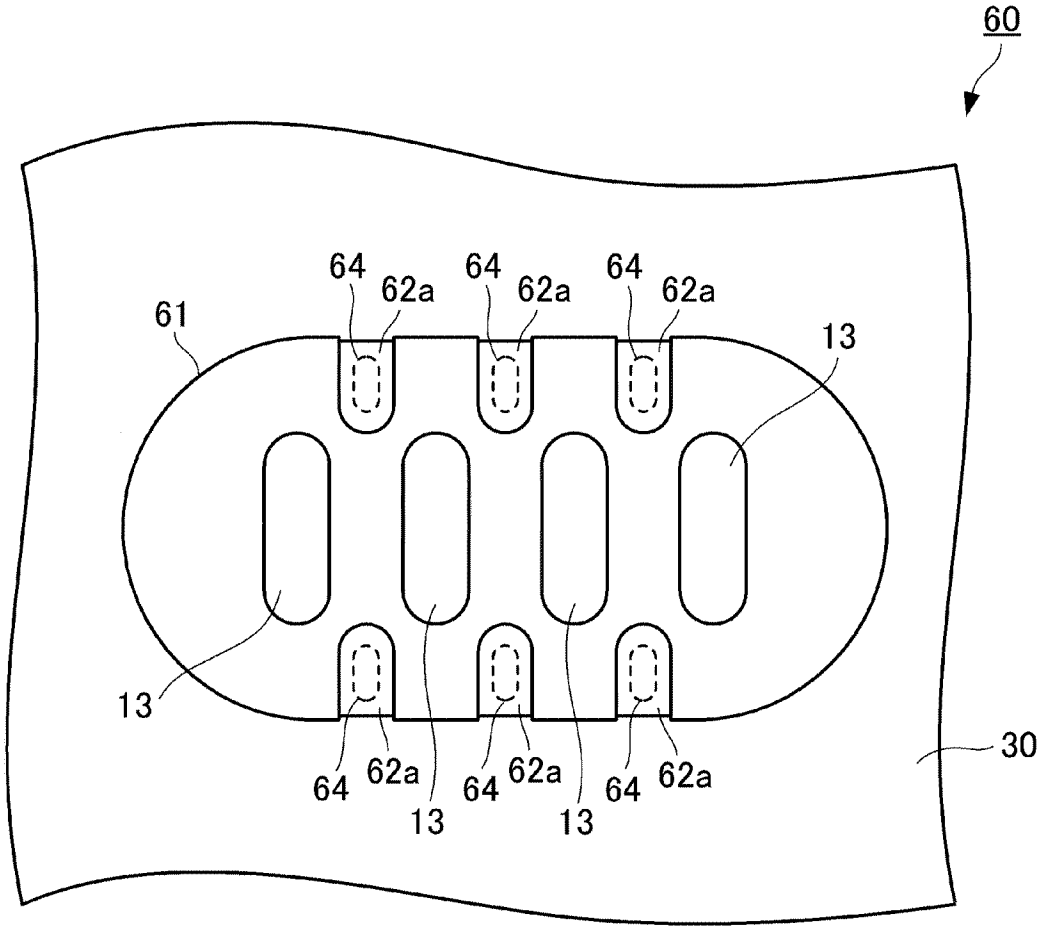
FIG. 15 is an explanatory view illustrating the connector of FIGS. 14A and 14B having been sewn on clothing.

FIG. 15 is a plan view illustrating the connector 60 sewn on the clothing 30. As illustrated in FIG. 15, the concaved surface portion 62*a* of the contacts 62 of the connector 60 is sewn on the clothing 30 with the electrically conductive sewing thread 64. The sewing thread 64 may be configured such that the thread body is formed from an electrically conductive material or an insulating thread body is covered with an electrically conductive substance. For example, the sewing thread 64 that can be used may be a stainless-steel fiber or a polyester thread body that is wound around with an elongated copper foil.

As described above, the contacts 62 and the electrically conductive pattern of an object of interest can be sewn together with the electrically conductive sewing thread 64, thereby electrically connecting both together with greater reliability. Furthermore, the sewing thread 64 for sewing the connector 60 on the clothing 30 is accommodated in the concaved surface portion 62*a*. Thus, when the connector 60 is mated with the mating connector 20, the electrically conductive sewing thread 64 will never interfere with the mating.

As described above, the embodiments of the present invention can be effectively used by being attached to a bendable object of interest such as clothing, and is useful generally for connectors and connector assemblies.

REFERENCE SIGNS LIST

1 connector assembly
10, 40, 50A, 50B, 50C, 50D, 60 connector
11, 41, 51A, 51B, 51C, 51D, 61 housing
11*a* front surface of housing (one plate surface)
11*b* rear surface of housing (opposite plate surface)
11*c* side surface of housing
12, 42, 52A, 52B, 52C, 52D, 62 contact
13 retainer member
14, 64 sewing thread
20 mating connector
21 mating-side housing
22 mating contact
23 mating-side retainer member
24 magnet
25 yoke
26 substrate
27 shell
28 electric wire
30 clothing (object of interest)
55A, 55B, 55C, 55D groove
62*a* concaved surface portion

The invention claimed is:

1. A connector configured to be mated with a mating connector, the connector comprising:

a plate-shaped housing;

an electrically conductive contact arranged on the housing; and a plurality of retainer members which are formed from a magnetic substance or magnet and arranged in the housing, and when the connector is mated with the mating connector, attracted to a magnet the mating connector has so as to hold a mating state, wherein the housing is formed from a bendable insulator, the plurality of retainer members are spaced apart from each other in a predetermined direction parallel to one plate surface of the housing, and the electrically conductive contact is formed from an electrically conductive rubber that penetrates through the housing.

2. A connector configured to be mated with a mating connector, the connector comprising:

a plate-shaped housing;

an electrically conductive contact arranged on the housing; and a plurality of retainer members which are formed from a magnetic substance or magnet and arranged in the housing, and when the connector is mated with the mating connector, attracted to a magnet the mating connector has so as to hold a mating state, wherein the housing is formed from a bendable insulator, the plurality of retainer members are spaced apart from each other in a predetermined direction parallel to one plate surface of the housing, and a groove along which the connector is sewn on an object of interest is formed in the one plate surface of the housing.

3. A connector configured to be mated with a mating connector, the connector comprising:

a plate-shaped housing;

an electrically conductive contact arranged on the housing; and a plurality of retainer members which are formed from a magnetic substance or magnet and arranged in the housing, and when the connector is mated with the mating connector, attracted to a magnet the mating connector has so as to hold a mating state, wherein the housing is formed from a bendable insulator, the plurality of retainer members are spaced apart from each other in a predetermined direction parallel to one plate surface of the housing, and on the one plate surface of the housing, the electrically conductive contact has a concaved surface portion to be sewn on an object of interest with an electrically conductive sewing thread.

4. A connector assembly comprising:

the connector according to claim 1; and a mating connector to be mated with the connector, wherein the mating connector comprising a mating-side housing, an electrically conductive mating contact provided to the mating-side housing, and a mating-side retainer member having a magnet provided to the mating-side housing, and when the connector and the mating connector are mated with each other, the electrically conductive contact and the electrically conductive mating contact are brought into contact with each other, and the retainer members and the mating-side retainer member are attracted to each other by a magnetic force, thereby holding a mating state.

5. A connector assembly comprising:

the connector according to claim 2; and a mating connector to be mated with the connector, wherein the mating connector comprising a mating-side housing, an electrically conductive mating contact provided to the mating-side housing, and a mating-side retainer member having a magnet provided to the mating-side housing, and when the connector and the mating connector are mated with each other, the electrically conductive contact and the electrically conductive mating contact are brought into contact with each other, and the retainer members and the mating-side retainer member are attracted to each other by a magnetic force, thereby holding a mating state.

6. A connector assembly comprising:

the connector according to claim 3; and a mating connector to be mated with the connector, wherein the mating connector comprising a mating-side housing, an electrically conductive mating contact provided to the mating-side housing, and a mating-side retainer member having a magnet provided to the mating-side housing, and when the connector and the mating connector are mated with each other, the electrically conductive contact and the electrically conductive mating contact are brought into contact with each other, and the retainer members and the mating-side retainer member are attracted to each other by a magnetic force, thereby holding a mating state.

* * * * *